US009755349B1

(12) United States Patent
Kim et al.

(10) Patent No.: US 9,755,349 B1
(45) Date of Patent: Sep. 5, 2017

(54) CONNECTOR ASSEMBLY WITH BLOCKING MEMBER

(71) Applicant: Sumitomo Wiring Systems, Ltd., Yokkaichi, Mie (JP)

(72) Inventors: Joseph Kim, Royal Oak, MI (US); Joseph Lanzotti, Grosse Pointe, MI (US)

(73) Assignee: Sumitomo Wiring Systems, Ltd., Yokkaichi, Mie (JP)

( * ) Notice: Subject to any disclaimer, the term of this patent is extended or adjusted under 35 U.S.C. 154(b) by 0 days.

(21) Appl. No.: 15/062,321

(22) Filed: Mar. 7, 2016

(51) Int. Cl.

| | |
|---|---|
| ***H01R 13/64*** | (2006.01) |
| ***H01R 13/52*** | (2006.01) |
| ***H01R 13/629*** | (2006.01) |
| ***H01R 43/18*** | (2006.01) |
| ***H01R 13/436*** | (2006.01) |
| ***H01R 43/16*** | (2006.01) |

(52) U.S. Cl.
CPC ..... *H01R 13/5202* (2013.01); *H01R 13/436* (2013.01); *H01R 13/629* (2013.01); *H01R 43/16* (2013.01); *H01R 43/18* (2013.01)

(58) Field of Classification Search
CPC ..... H01R 13/5202; H01R 13/629; H01R 13/7033; H01R 43/16; H01R 43/18; H01R 13/5205; H01R 13/436
USPC ..... 439/374
See application file for complete search history.

(56) References Cited

U.S. PATENT DOCUMENTS

| | | | | |
|---|---|---|---|---|
| 5,273,448 | A * | 12/1993 | Myer | H01R 13/7033 439/188 |
| 8,662,921 | B2 | 3/2014 | Kataoka | |
| 2006/0086900 | A1* | 4/2006 | Nakamura | H01R 13/6633 250/239 |
| 2008/0233784 | A1* | 9/2008 | Patterson | H01R 13/5205 439/278 |

FOREIGN PATENT DOCUMENTS

| | | | |
|---|---|---|---|
| JP | 08236247 | A | 9/1996 |
| JP | 2015195134 | A | 11/2015 |

* cited by examiner

*Primary Examiner* — Jean F Duverne
(74) *Attorney, Agent, or Firm* — Dinsmore & Shohl LLP

(57) ABSTRACT

A connector assembly and system assembling an electric connector assembly are provided. The connector assembly includes a connector housing having a plurality of terminal cavities greater than the predetermined number of electric connections so as to define an empty terminal cavity and a filled terminal cavity. The connector housing further includes a blocking member. The blocking member is the blocking member disposed within each of the empty terminal cavities. Accordingly, the blocking member closes off each of the empty terminal cavities so as to prevent fluid transfer between the terminal positioning assurance member and the connector positioning assurance member so as to prevent fluid and debris transfer between the terminal positioning assurance member and the connector positioning assurance member, or stated in another way, prevents fluid and debris transfer between the first open end and the second open end.

20 Claims, 9 Drawing Sheets

CONNECTOR ASSEMBLY WITH BLOCKING MEMBER

FIELD OF THE INVENTION

The present specification generally relates to a connector housing assembly and a system for assembling an electric connector assembly.

BACKGROUND OF THE INVENTION

Connector assemblies are currently known and used. Connector assemblies connect terminal ends of a cable or an electrical wire together so as to supply an electric signal from a source to a component. An illustrative view of a prior art connector assembly is provided in FIG. 1A, and n exploded view of the connector assembly showing the components is provided in FIG. 1B.

The connector assembly 1000 includes a connector housing 1002. The connector housing 1002 includes a first open end 1004 opposite a second open end 1006. The connector assembly 1000 further includes a terminal positioning assurance member 1008 configured to engage the first open end 1004, and a connector positioning assurance member 1010 configured to engage the second open end 1006.

FIGS. 1C and 1D illustrate the connection of the terminal positioning assurance member 1008, the connector positioning assurance member 1010 and the connector housing 1002. The connector housing 1002 includes a plurality of terminal cavities 1012. The terminal cavities 1012 extend between the first and second open end 1006s of the connector housing 1002.

With reference now to FIGS. 2A and 2B, the connector housing 1002 is configured to electrically couple a first wire 1014 to a second wire 1016. FIGS. 2A and 2B show the connector housing 1002 configured to couple two wires 1014, 1016 together so as to form two electric connections 1018. The electric connections 1018 may be formed between a terminal blade of a first wire coupled to a female terminal end of a second wire.

For illustrative purposes, the connector assembly 1000 is shown configured to accommodate three electric connections 1018. However, it should be appreciated that the connector assembly 1000 may be used in a wire harness system where only one or two electric connections 1018 are needed. Thus, two or more terminal cavities 1012 remain open. Having the terminal cavities 1012 open exposes the electric connection 1018 to fluids and environmental debris which may erode the electric connection 1018. Accordingly, it is known to use a plug 1020 to close any open terminal cavity 1012.

FIGS. 2B and 2C show a plug 1020 inserted into the open terminal cavity 1012. The plugs 1020 are manually installed. Thus the closure of the open terminal cavity 1012 requires a worker to remember to stall the plug 1020. FIGS. 2B and 2D show a terminal cavity 1012 with an electric connection 1018.

Accordingly, it remains desirable to have a connector assembly 1000 and a system wherein the open terminal cavities are closed prior to installation into a wire harness system so as to ensure that all of the open cavities are closed.

SUMMARY OF THE INVENTION

A connector assembly for housing a predetermined number of electric connection s is provided. The connector assembly includes a connector housing having a plurality of terminal cavities greater than the predetermined number of electric connection s so as to define an empty terminal cavity and a filled terminal cavity. As used herein, the term "empty terminal cavity" is a terminal cavity void of an electric connection and the term "filled terminal cavity" is a terminal cavity which houses one of the predetermined number of electric connections. As used herein, the term "electric connection" refers to the electric coupling of the ends of two or more wires. The terminal cavities are disposed between a first open end opposite a second open end. The connector assembly further includes a terminal positioning assurance member configured to engage the first open end, and a connector positioning assurance member configured to engage the second open end.

The connector housing further includes a blocking member. The blocking member is disposed within each of the empty terminal cavities. Accordingly, the blocking member closes off each of the empty terminal cavities so as to prevent fluid transfer between the terminal positioning assurance member and the connector positioning assurance member so as to prevent fluid and debris transfer between the terminal positioning assurance member and the connector positioning assurance member, or stated in another way, prevents fluid and debris transfer between the first open end and the second open end.

A system for assembling an electric connector assembly is also provided. The electric connector assembly is configured to hold a predetermined number of electric connections. Each of the predetermined number of electric connections is formed by a coupling of a male terminal to a female terminal. The system includes a connector housing having a first open end opposite a second open end. The connector housing includes a plurality of terminal cavities greater than the predetermined number of electric connections so as to define an empty terminal cavity and a filled terminal cavity, wherein the empty terminal cavity is void of a terminal connection and a filled terminal cavity houses one of the predetermined number of electric connections, the connector housing further includes a first open end opposite a second open end, the plurality of terminal cavities extend between the first open end and the second open end.

The system further includes a terminal positioning assurance member configured to engage the first open end, and a connector positioning assurance member configured to engage the second open end. The terminal position assurance member is configured to register the ends of either the first wire or the second wire into the first open end of the connector housing and the connector positioning assurance member is configured to register the other end of either the first wire or second wire end into the second open end of the connector housing.

The system further includes a predetermined number of blocking members, each blocking member is disposed within each of the empty terminal cavities. The blocking member closes off each empty terminal cavity so as to prevent fluid transfer between the terminal positioning assurance member and the connector positioning assurance member.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be better understood when read in conjunction with the following drawings where like structure is indicated with like reference numerals and in which:

DETAILED DESCRIPTION OF THE PREFERRED EMBODIMENTS

A connector assembly for housing a predetermined number of electric connections includes a connector housing having a plurality of terminal cavities greater than the predetermined number of electric connections so as to define an empty terminal cavity and a filled terminal cavity. The terminal cavities are disposed between a first open end opposite a second open end.

The connector housing further includes a blocking member. The blocking member is disposed within each of the empty terminal cavities. Accordingly, the blocking member closes off each of the empty terminal cavities so as to prevent fluid transfer between the terminal positioning assurance member and the connector positioning assurance member so as to prevent fluid and debris transfer between the terminal positioning assurance member and the connector positioning assurance member, or stated in another way, prevents fluid and debris transfer between the first open end and the second open end.

It should be further appreciated that the connector assembly may be manufactured to accommodate various wire harness assembly configurations so as to eliminate the need for a worker to install a plug into an empty terminal cavity. Thus, each wire harness system for which the connector assembly is manufactured provides a visual guide of where to install the terminal connection, which helps in the manufacturing and assembling process of electric connector assembly.

Figure 1A:
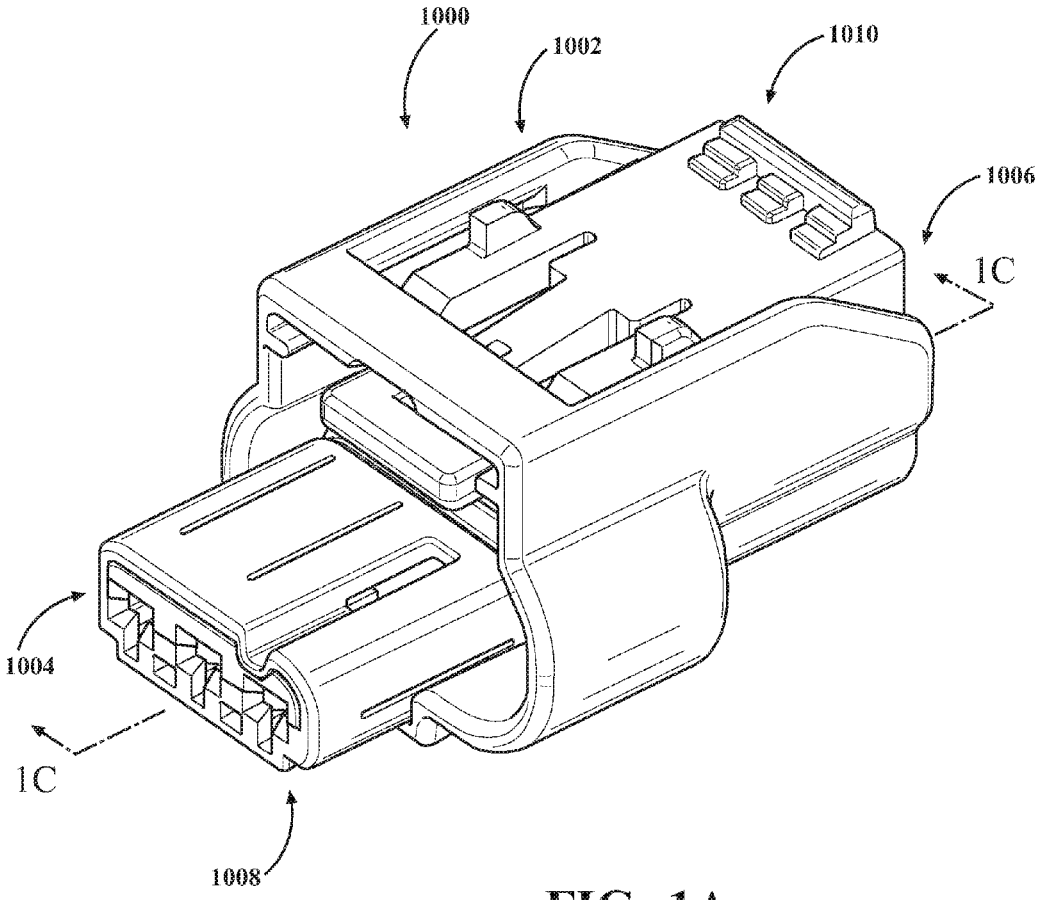
FIG. 1A PRIOR ART
FIG. 1A is a perspective view showing a prior art connector assembly assembled.
Figure 1B:
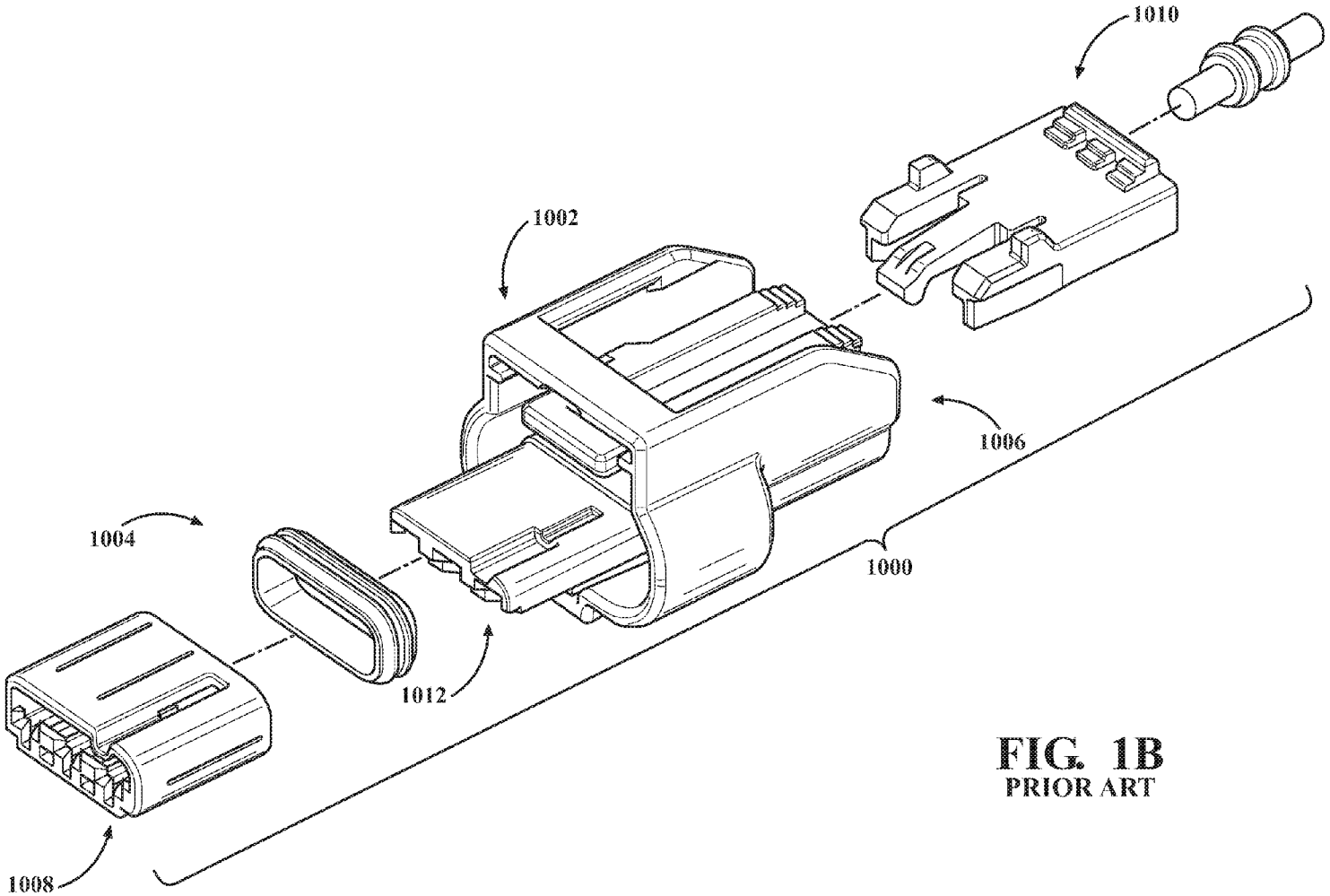
FIG. 1B PRIOR ART
FIG. 1B is an exploded view of the connector assembly shown in FIG. 1A.
Figure 1C:
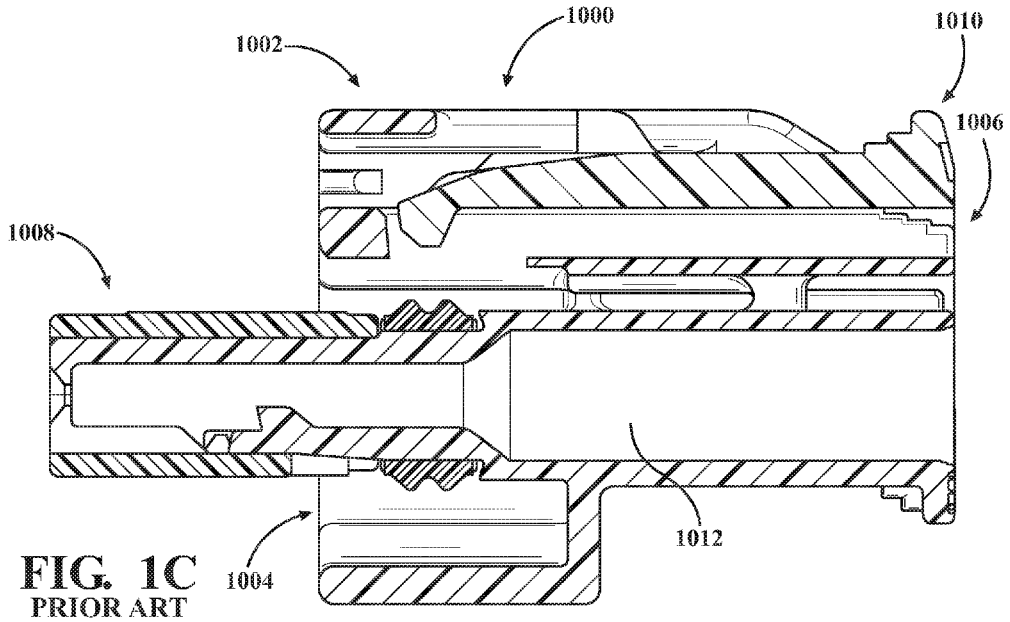
FIG. 1C PRIOR ART
FIG. 1C is cross-sectional view of FIG. 1A taken along lines 1C.
Figure 1D:
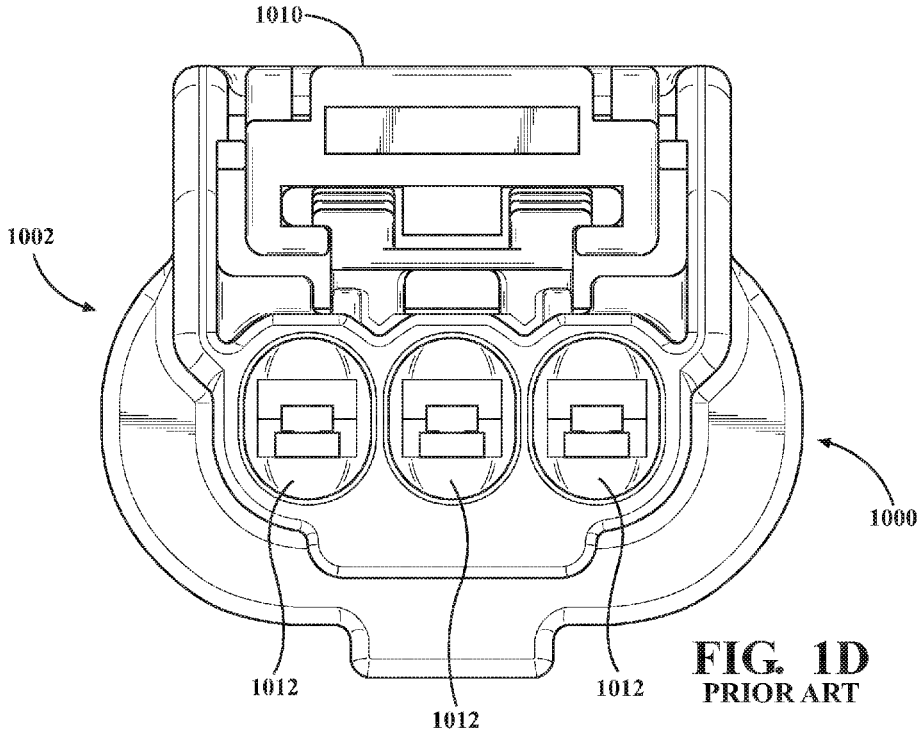
FIG. 1D PRIOR ART
FIG. 1D a view of FIG. 1A taken from the second open end.
Figure 2A:
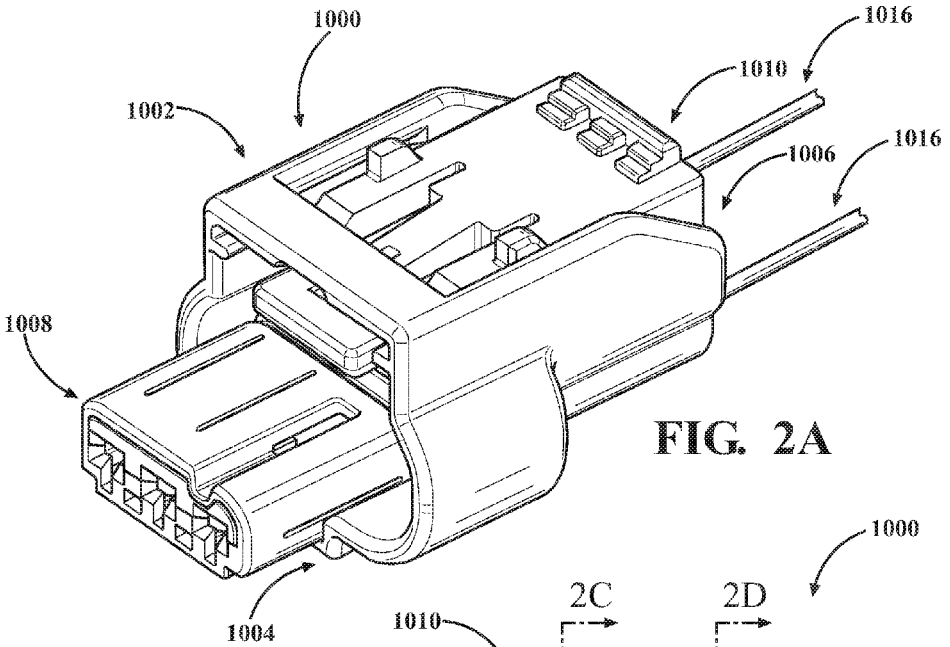
FIG. 2A is a perspective view of the connector assembly shown in FIG. 1A with a pair of electric connections.
Figure 2B:
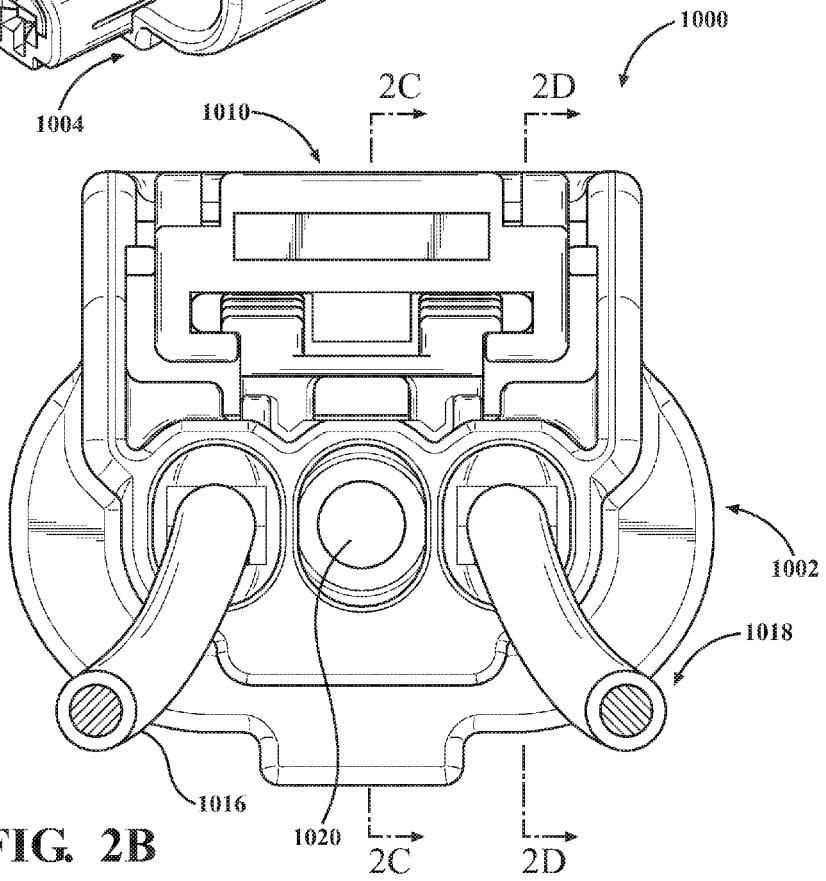
FIG. 2B is a view of FIG. 2A taken from the second open end.
Figure 2C:
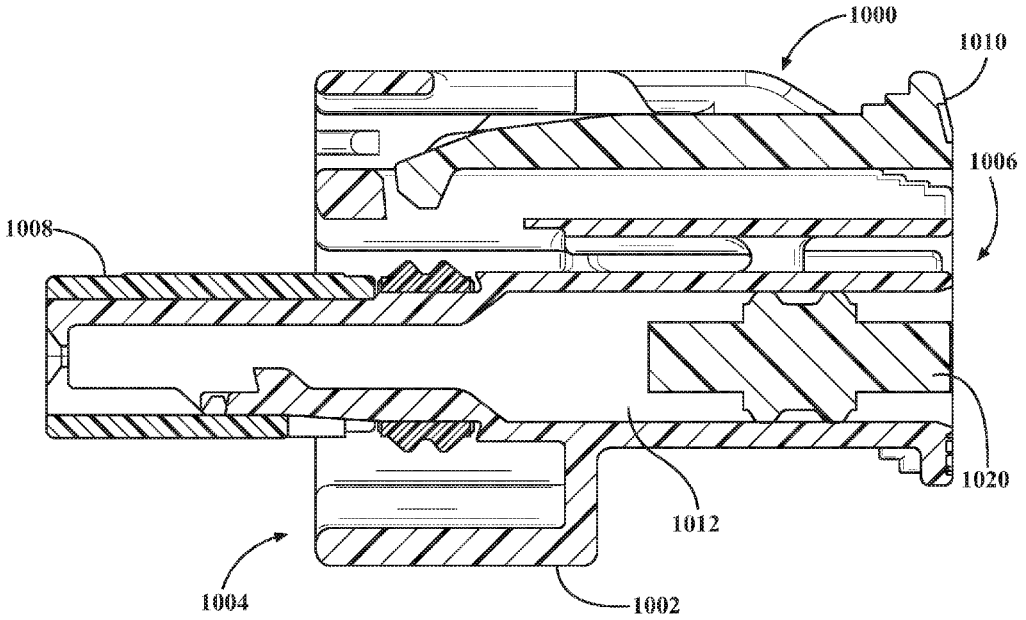
FIG. 2C is a cross-sectional view of FIG. 2B taken along lines 2C-2C.
Figure 2D:
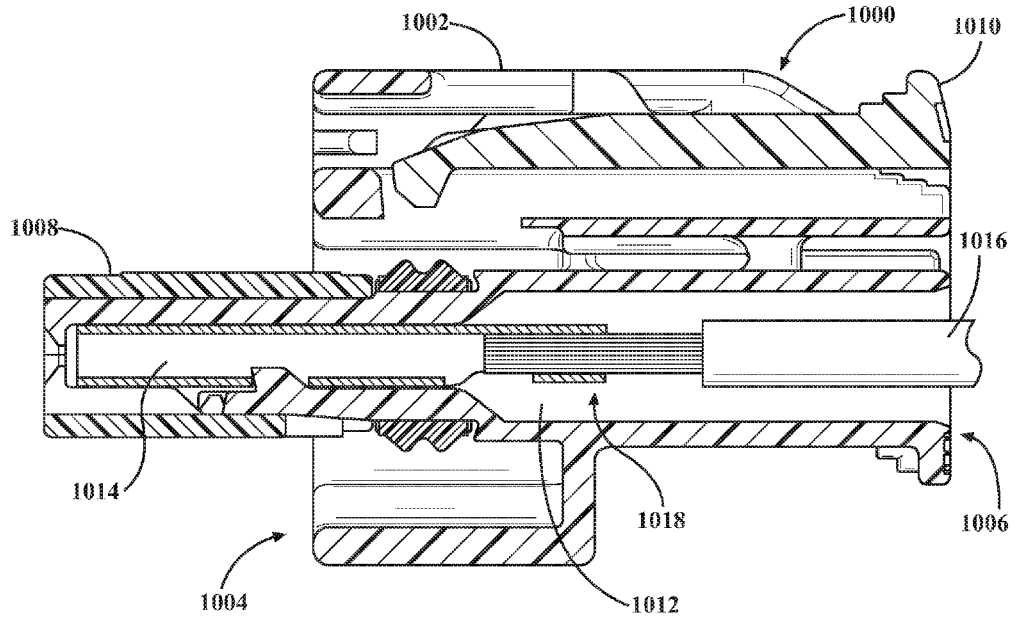
FIG. 2D is a cross-sectional view of FIG. 2B taken along lines 2D-2D.
Figure 3:
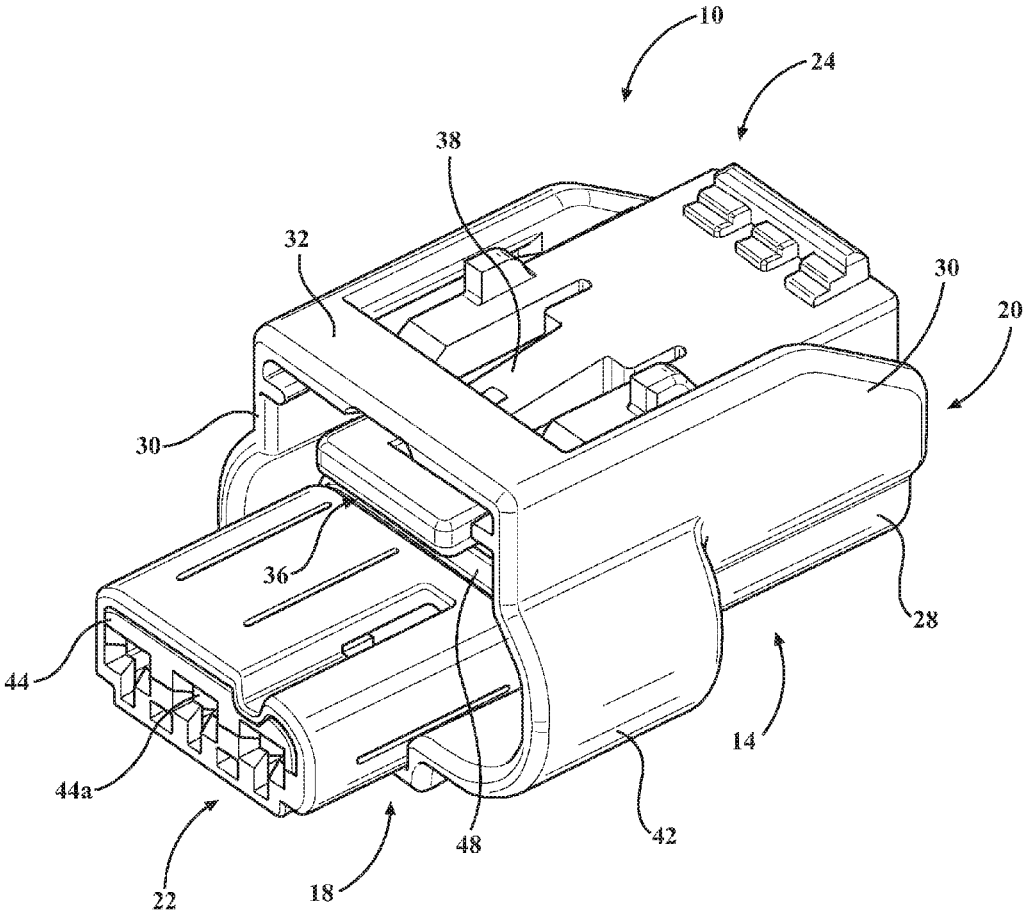
FIG. 3 schematically depicts a perspective view of a connector assembly according to one or more embodiments described and illustrated herein.
Figure 4:
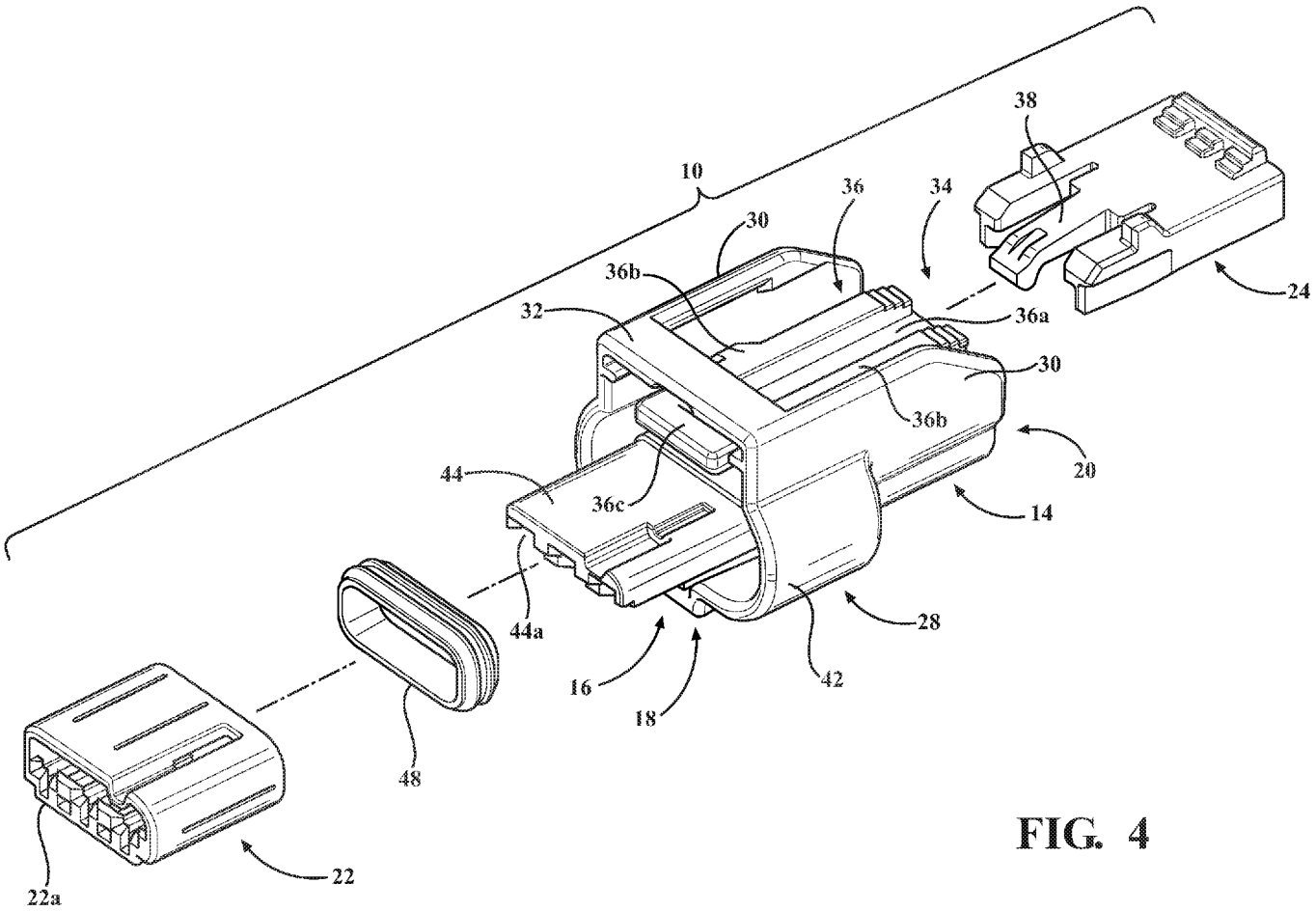
FIG. 4 is an exploded view of the connector assembly shown in FIG. 3.
Figure 5:
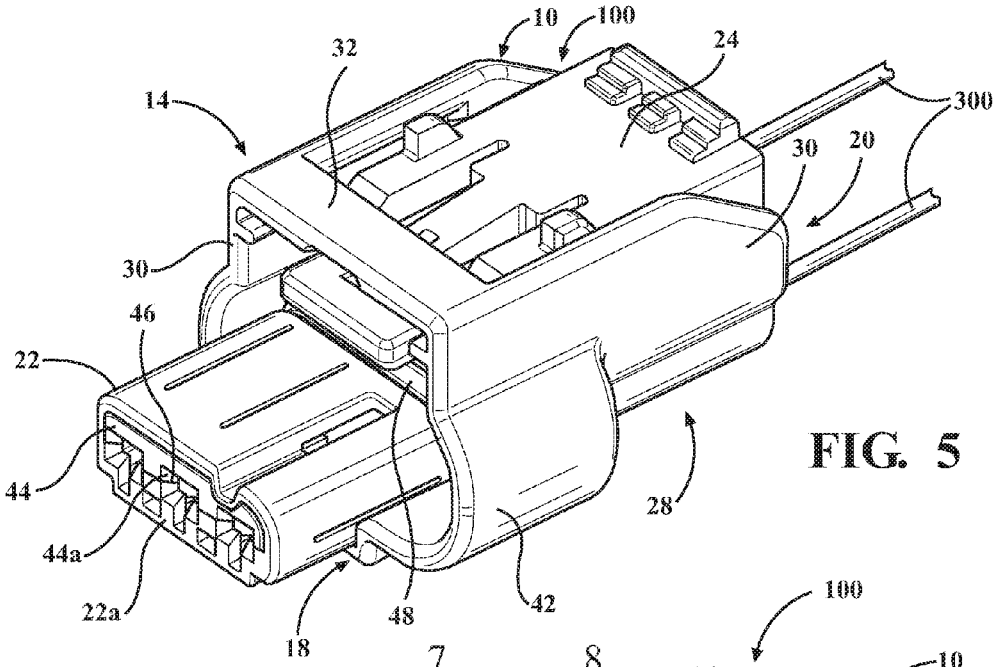
FIG. 5 is a view of the connector assembly shown in FIG. 3 with two electric connections.

With reference now to FIGS. 3-8 an example connector assembly 10 for housing a predetermined number of electric connections 12 (shown in FIGS. 5, 6 and 7) is provided. FIG. 3 is a perspective view of an illustrative embodiment of the connector assembly 10. FIG. 4 is an exploded view of the connector assembly 10 shown in FIG. 3.

The connector assembly 10 includes a connector housing 14. The connector housing 14 includes a plurality of terminal cavities 16 greater than the predetermined number of electric connections 12 so as to define an empty terminal cavity 16*a* and a filled terminal cavity 16*b*, wherein the empty terminal cavity 16*a* is void of an electric connection 12 and a filled terminal cavity 16*b* houses one of the predetermined number of electric connections 12. The connector housing 14 further includes a first open end 18 opposite a second open end 20. A terminal positioning assurance member 22 is configured to engage the first open end 18, and a connector positioning assurance member 24 configured to engage the second open end 20.

Figure 6:
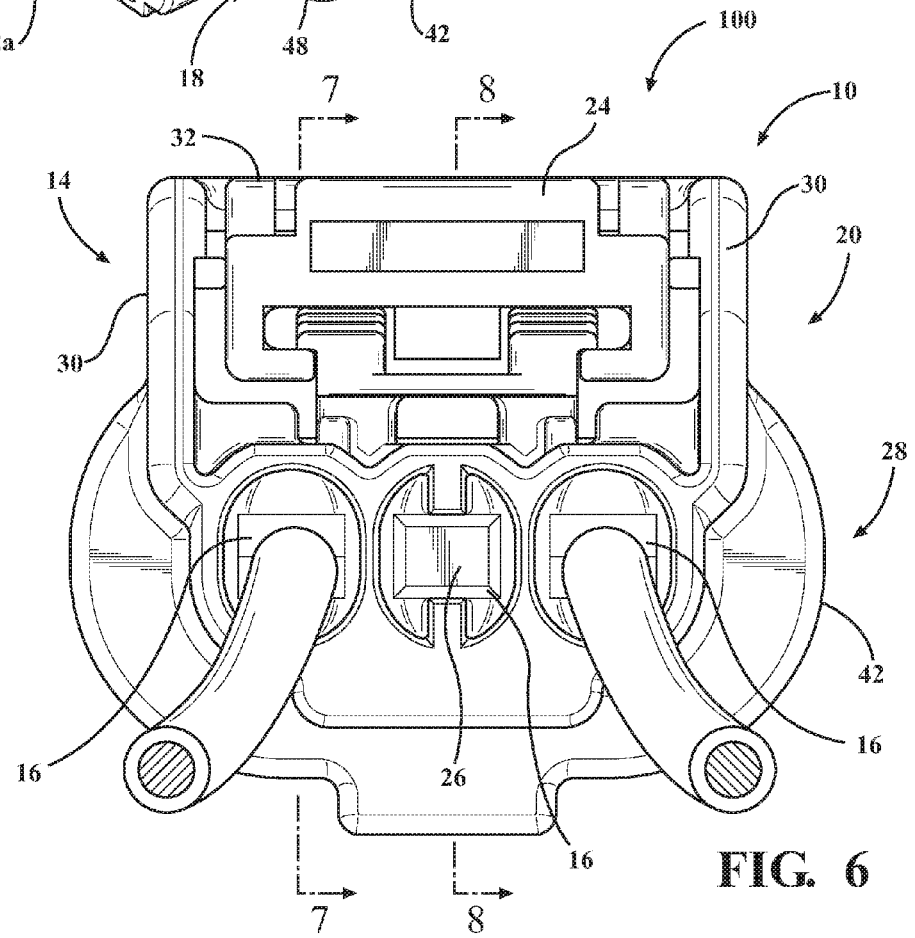
FIG. 6 is a view of the connector assembly shown in FIG. 5 taken from the second open end.
Figure 7:
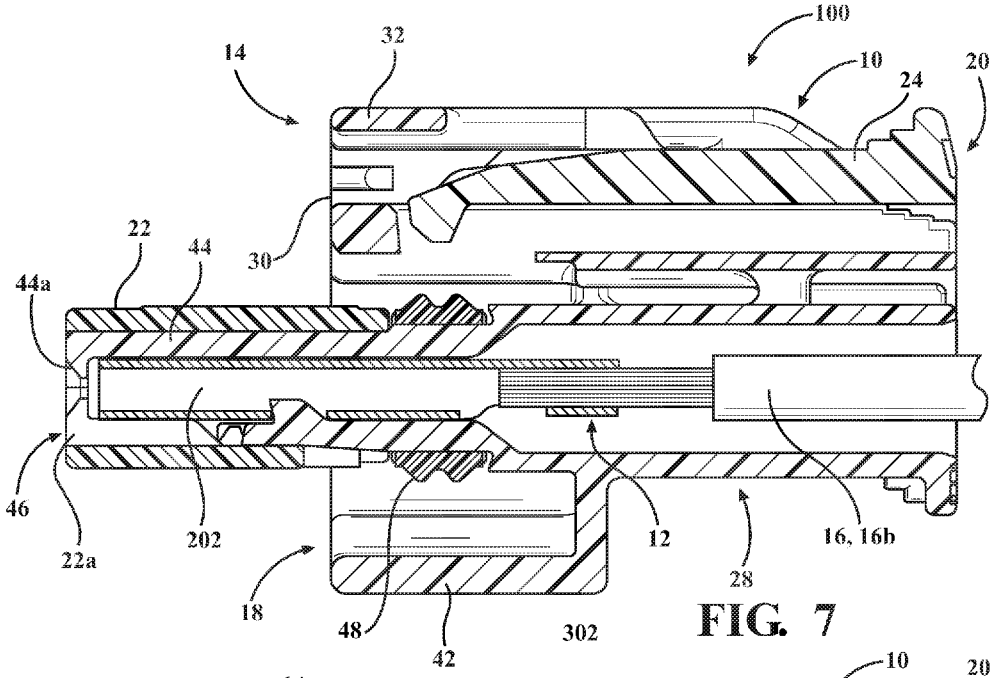
FIG. 7 is a cross-sectional view of FIG. 6 taken along lines 7-7.
Figure 8:
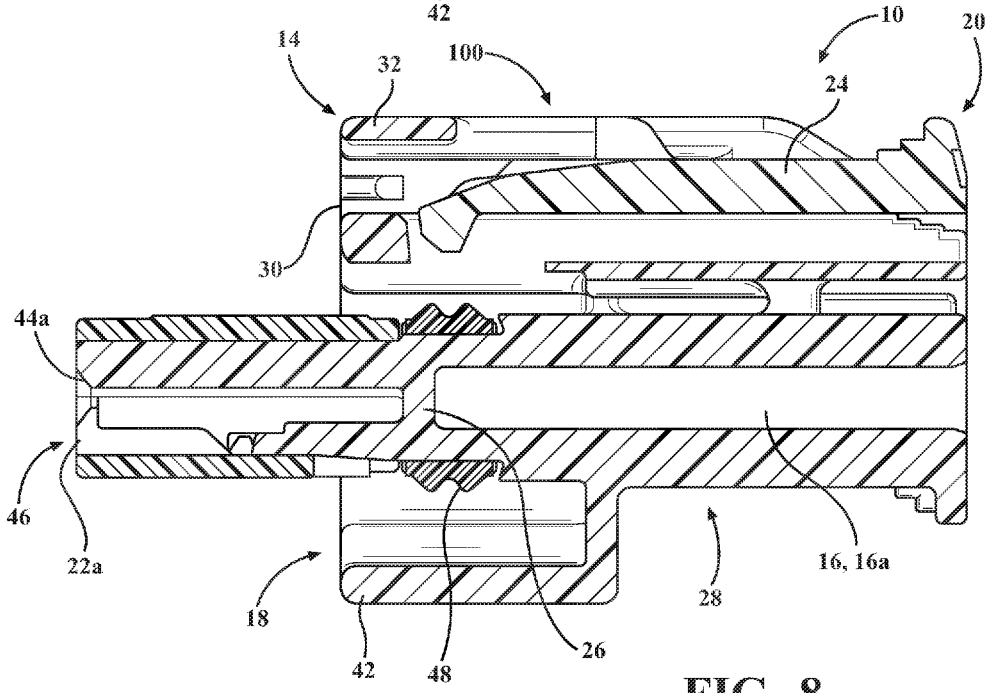
FIG. 8 is a cross-sectional view of FIG. 6 taken along lines 8-8.

With reference now to FIGS. 6 and 8, the connector assembly 10 further includes a blocking member 26. The blocking member 26 is disposed within each of the empty terminal cavities 16*a*. The blocking member 26 closes off each of the empty terminal cavities 16*a* so as to prevent fluid transfer between the terminal positioning assurance member 22 and the connector positioning assurance member 24.

With reference again to FIGS. 3 and 4, the connector housing 14 includes a body portion 28 having a first open end 18 opposite a second open end 20. The body portion 28 includes a pair of upper guide walls 30 spaced apart from each other. The pair of upper guide walls 30 is disposed on the second open end 20 of the body portion 28. A transverse member 32 connects the proximal upper ends of the upper guide walls 30 to each other. A top surface 34 adjacent the second open end 20 includes a first clip 36, the first clip 36 is illustratively shown as an axial slot 36*a* defined by a pair of elongated side edges 36*b* and a front edge 36*c*.

The connector positioning assurance member 24 includes a second clip 38 configured to engage the first clip 36 so as to secure the connector positioning assurance member 24 to the connector housing 14. The connector positioning assurance member 24 is configured to position a connector (not shown) with respect to the connector housing 14.

A sleeve portion 42 is disposed on the first open end 18. A terminal support member 44 is disposed generally centered within the sleeve portion 42. The terminal support member 44 has a plurality of top elongated channels 44*a*. The number of top elongated channels 44*a* is equal to that of the number of terminal cavities 16. Each of the top elongated channels 44*a* is configured to register with a corresponding plurality of terminal cavities 16.

Likewise, the terminal positioning assurance member 22 includes a plurality of bottom elongated channels 22*a*, each of the plurality of bottom elongated channels 22*a* is configured to register with a corresponding plurality of top elongated channels 44*a* so as to form a plurality of blade support channels 46. The blade support channels 46 are configured to support a terminal blade/end of either a first wire 200 or second wire 300. For illustrative purposes, the terminal positioning assurance member 22 is shown configured to hold a male terminal blade 202, but it should be appreciated that the terminal positioning assurance member 22 may be configured to hold female terminal end 302. The blade support channels 46 are configured for supporting a terminal blade/end.

The connector assembly 10 may further include a connector seal 48. The connector seal 48 is configured to engage the first open end 18 of the connector housing 14. The connector seal 48 is pinched between the first open end 18 of the connector housing 14 and the terminal positioning assurance member 22 so as to create a sealed engagement of the electric connection 12 within a respective terminal cavity 16.

With reference now to FIGS. 5-8, the connector assembly 10 is configured to accommodate a plurality of electric connections 12. For illustrative purposes, the connector assembly 10 is shown configured to support a pair of electric connections 12, and includes three terminal cavities 16. However, it should be appreciated that the number of electric connections 12 and terminal cavities 16 shown is provided for illustrative purposes and is not limiting. The electric connections 12 are disposed within a respective filled terminal cavity 16*b*, and a blocking member 26 is shown disposed within an empty terminal cavity 16*a*. The blocking member 26 is integrally formed within the empty terminal cavity 16*a*. It should be appreciated that in instances where there are multiple empty terminal cavities 16*a*, that the blocking member 26 is integrally formed within each of the empty terminal cavities 16*a*.

The blocking member 26 and the connector housing 14 may be monolithic, that is formed as a single unit in a mold. Such a feature may be desirable from a manufacturing stand point as the connector housing 14 may be reconfigured with multiple blocking members 26 by simply changing a tool piece. Thus, the manufacturing process is not complicated by changing the placement of the blocking member 26. For instance, FIGS. 5-8 show the blocking member 26 disposed in the center terminal cavity; whereas the outer terminal cavities 16 are open so as to be later filled with an electric connection 12. If the manufacturer desires to move the blocking member 26 to an outer terminal cavity to accommodate packaging constraints, the manufacturer simply changes the die tool.

Likewise, the connector housing 14 may include a plurality of blocking members 26. Each of the plurality of blocking members 26 is disposed within a respective empty terminal cavity 16*a*. For instance, the connector housing 14 may include five terminal cavities 16. In some instance, the wire harness system may utilize three electric connections 12, thus two of the terminal cavities 16 should be closed. The blocking member 26 may be integrally formed in the two empty terminal cavities 16*a* so as to prevent fluid and debris from being entering into the filled terminal cavities 16 and causing the terminal connection to fail.

An illustrative description of the operation of the connector assembly 10 is now provided with reference to FIGS. 4-8. The connector seal 48 is slid over the terminal support member 44, and the terminal positioning assurance member 22 is snap fitted onto the terminal support member 44 in a pre-load condition which provides tolerance for the introduction of a set of first wires 200 into the terminal blade support channels 46.

A set of second wires 300 is inserted into the second open end 20 of the connector housing 14, and the connector positioning assurance member 24 is snapped onto the second open end 20 of the connector housing 14 by engagement between the first clip 36 and the second clip 38. Accordingly, the terminal ends 302 of the set of second wires 300 are mounted within a portion of a respective terminal cavity 16. For illustrative purposes, the terminal ends of the second wire 300 are shown disposed within the outer terminal cavities 16. It should be appreciated that the assembly worker does not have to reference where to place the second wires 300 or the first wires 200 as the empty terminal cavity 16*a* is closed off by the blocking member 26.

The terminal positioning assurance member 22 is then pushed further into the body portion 28 of the connector housing 14 so as to place the terminal positioning assurance member 22 in a locked condition, wherein the set of first wires 200 are then inserted into the outer terminal blade support channels 46 and pressed into contact with respective terminal ends of the second wire 300. It should be appreciated that the assembly worker does not have to reference where to place the first wires 200 as the empty terminal cavity 16*a* is closed off by the blocking member 26. Accordingly, the connector assembly 10 is assembled and the need to install a plug eliminated as the empty terminal cavity 16*a* is closed by the blocking member 26.

A system 100 for assembling an electric connector assembly 10 is also provided. The electric connector assembly 10 is configured to hold a predetermined number of electric connections 12. Each of the electric connections 12 is formed by a coupling of a terminal ends of a first wire 200 and a second wire 300.

The system 100 includes a connector housing 14. The connector housing 14 includes a plurality of terminal cavities 16 greater than the predetermined number of electric connections 12 so as to define an empty terminal cavity 16*a* and a filled terminal cavity 16*b*, wherein the empty terminal cavity 16*a* is void of an electric connection 12 and a filled terminal cavity 16*b* houses one of the predetermined number of electric connections 12. The connector housing 14 further includes a first open end 18 opposite a second open end 20. A terminal positioning assurance member 22 is configured to engage the first open end 18, and a connector positioning assurance member 24 configured to engage the second open end 20.

The system 100 further includes a predetermined number of blocking members 26. Each blocking member 26 is disposed within each empty terminal cavity 16*a*. The blocking member 26 closes off each empty terminal cavity 16*a* so as to prevent fluid transfer between the terminal positioning assurance member 22 and the connector positioning assurance member 24.

With reference again to FIGS. 3 and 4, the connector housing 14 includes a body portion 28 having a first open end 18 opposite a second open end 20. The body portion 28 includes a pair of upper guide walls 30 spaced apart from each other. The pair of upper guide walls 30 is disposed on the second open end 20 of the body portion 28. A transverse member 32 connects the proximal upper ends of the upper guide walls 30 to each other. A top surface 34 adjacent the second open end 20 includes first clip 36, the first clip 36 is illustratively shown as an axial slot 36*a* defined by a pair of elongated side edges 36*b* and a front edge 36*c*.

The connector positioning assurance member 24 includes a second clip 38 configured to engage the first clip 36 so as to secure the connector positioning assurance member 24 to the connector housing 14. The connector positioning assurance member 24 includes a pair of ledges 40 disposed on the undersurface configured to slidably engage the top surface 34 of the body portion 28, as illustratively shown in FIG. 6.

A sleeve portion 42 is disposed on the first open end 18. A terminal support member 44 is disposed generally centered within the sleeve portion 42. The terminal support member 44 has a plurality of top elongated channels 44*a*. The number of top elongated channels 44*a* is equal to that of the number of terminal cavities 16. Each of the top elongated channels 44*a* is configured to register with a corresponding plurality of terminal cavities 16.

Likewise, the terminal positioning assurance member 22 includes a plurality of bottom elongated channels 22*a*, each of the plurality of bottom elongated channels 22*a* is configured to register with a corresponding plurality of top elongated channel so as to form a plurality of blade support channels 46. The blade support channels 46 are configured to support a terminal blade/end of either a first or second wire. For illustrative purposes, the terminal positioning assurance member 22 is shown configured to hold a male terminal blade 202, but it should be appreciated that the terminal positioning assurance member 22 may be configured to hold female terminal end 302. The blade support channels 46 are configured for supporting a terminal blade/end.

The system 100 may further include a connector seal 48. The connector seal 48 is configured to engage the first open end 18 of the connector housing 14. The connector seal 48 is pinched between the first open end 18 of the connector housing 14 and the terminal positioning assurance member 22 so as to create a sealed engagement of the terminal connection within a respective terminal cavity.

With reference now to FIGS. 5-8, the system 100 is configured to accommodate a plurality of electric connections 12. For illustrative purposes, the system 100 is shown configured to support a pair of electric connections 12, and includes three terminal cavities 16. However, it should be appreciated that the number of electric connections 12 and cavities shown is provided for illustrative purposes and is not limiting. The electric connections 12 are disposed within a respective filled terminal cavity 16*b*, and a blocking member 26 is shown disposed within an empty terminal cavity 16*a*. The blocking member 26 is integrally formed within the empty terminal cavity 16*a*. It should be appreciated that in instances where there are multiple empty terminal cavities 16*a*, that the blocking member 26 is integrally formed within each of the empty terminal cavities 16*a*.

The blocking member 26 and the connector housing 14 may be monolithic, that is formed as a single unit in a mold. Such a feature may be desirable from a manufacturing stand point as the connector housing 14 may be reconfigured with multiple blocking members 26 by simply changing a die piece. Thus, the manufacturing process is not complicated by changing the placement of the blocking member 26. For instance, FIGS. 5-8 show the blocking member 26 disposed in the center terminal cavity; whereas the outer terminal cavities 16 are open so as to be later filled with an electric connection 12. If the manufacturer desires to move the blocking member 26 to an outer terminal cavity to accommodate packaging constraints, the manufacturer simply changes the die.

Likewise, the connector housing 14 may include a plurality of blocking members 26. Each of the plurality of blocking members 26 is disposed within a respective empty terminal cavity 16*a*. For instance, the connector housing 14 may include five terminal cavities 16. In some instance, the wire harness system may utilize three electric connections 12, thus two of the terminal cavities 16 should be closed. The blocking member 26 may be integrally formed in the two empty terminal cavities 16*a* so as to prevent fluid and debris from being entering into the filled terminal cavities 16 and causing the terminal connection to fail.

An illustrative description of the operation of the system 100 is now described by reference to FIGS. 3-8. The illustrative description is directed towards teaching and is not limiting to the scope of the appended claims, and thus the references made to FIGS. 3-8 are made to help illustrate the concepts described herein and not limit them. The system 100 is shown used in an electric connector assembly 10 requiring two electric connections 12 and having a connector housing 14 with three terminal cavities 16. Thus, it should be appreciated that the system 100 is beneficial to adaptive manufacturing in that the connector housing 14 may be used in electric connector assemblies with one, two or three electric connections 12. It should be further appreciated that the connector assembly 10 maybe include a connector housing 14 having more than three terminal cavities 16. The connector housing 14 may be configured based upon the number of electric connections 12 required by the electric connector assembly 10.

The connector housing 14 may be formed by an injection molded process wherein different dies may be inserted to create a blocking member 26 in any desired terminal cavity 16. Thus, in instances where a wire harness system requires two electric connections 12 as shown in FIGS. 5-8, a die is inserted into the injection molding tool to form a monolithic blocking member 26 in the center terminal cavity. A different die may be used to form the blocking member 26 in one of the outer terminal cavities 16, and yet a different die may be used to form three open terminal cavities 16 in the instance where the connector housing 14 is configured to house three electric connections 12.

It should be appreciated that having the blocking members 26 formed in the connector housing 14 before the electric connector assembly 10 is installed into a predetermined wire harness system eliminates the step of manually inserting a plug, provides visual instructions on where the wires are to be inserted, and ensures that terminal connection is sealed.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination.

We claim:

1. A connector assembly for housing a predetermined number of electric connections, the connector assembly comprising:

a connector housing having a plurality of terminal cavities greater than the predetermined number of electric connections so as to define an empty terminal cavity and a filled terminal cavity, wherein the empty terminal cavity is void of a terminal connection and a filled terminal cavity houses one of the predetermined number of electric connections, the connector housing further including a first open end opposite a second open end;

a terminal positioning assurance member configured to engage the first open end;

a connector positioning assurance member configured to engage the second open end; and a blocking member, the blocking member disposed within each of the empty terminal cavities separating the terminal positioning assurance member from the connector positioning assurance member, the blocking member being a generally planar member disposed on a plane orthogonal to a longitudinal axis of the empty terminal cavity, the blocking member closing off said each of the empty terminal cavities so as to prevent fluid transfer between the terminal positioning assurance member and the connector positioning assurance member.

2. The connector assembly as set forth in claim 1, wherein the blocking member is integrally formed within each of the empty terminal cavities.

3. The connector assembly as set forth in claim 2, wherein the blocking member and the connector housing is monolithic.

4. The connector assembly as set forth in claim 1, further including a connector seal, the connector seal configured to engage the first open end of the connector housing, wherein the connector seal is pinched between the first open end of the connector housing and the terminal positioning assurance member.

5. The connector assembly as set forth in claim 1, wherein the connector housing includes a first clip, the first clip disposed on the second open end of the connector housing, the first clip configured to engage the connector positioning assurance member.

6. The connector assembly as set forth in claim 5, wherein the connector positioning assurance member includes a second clip configured to engage the first clip of the connector housing.

7. The connector assembly as set forth in claim 1, wherein the connector housing includes a terminal support member, the terminal support member having a plurality of top elongated channels, each of the plurality of top elongated channels configured to register with a corresponding plurality of terminal cavities.

8. The connector assembly as set forth in claim 7, wherein the terminal positioning assurance member includes a plurality of bottom elongated channels, each of the plurality of bottom elongated channels configured to register with a corresponding plurality of top elongated channel so as to form a plurality of terminal blade support channels for supporting a terminal blade.

9. A connector assembly as set forth in claim 1, wherein the blocking member is generally centered within each of the empty terminal cavities so as to define a first surface opposite a second surface wherein the first surface is open to the terminal positioning assurance member and the second surface is open to the connector positioning assurance member.

10. A connector housing for housing a predetermined number of electric connections, the connector housing comprising:

a body portion having a first open end opposite a second open end;

a plurality of terminal cavities greater than the predetermined number of electric connections so as to define an empty terminal cavity and a filled terminal cavity, wherein the empty terminal cavity is void of a terminal connection and a filled terminal cavity houses one of the predetermined number of electric connections; and a blocking member, the blocking member disposed within each of the empty terminal cavities and separating the terminal positioning assurance member from the connector positioning assurance member, the blocking member being a generally planar member disposed on a plane orthogonal to a longitudinal axis of the empty terminal, the blocking member closing off each of the empty terminal cavities so as to prevent fluid transfer between the first open end and the second open end.

11. The connector housing as set forth in claim 10, wherein the blocking member is integrally formed within said one of the plurality of terminal cavities.

12. The connector housing as set forth in claim 10, wherein the blocking member and the body portion is monolithic.

13. A system for assembling an electric connector assembly, the electric connector assembly configured to hold a predetermined number of electric connections, each of the predetermined number of electric connections formed by a coupling of a terminal end of a first wire to a terminal end of a second wire, the system comprising:

a connector housing having a first open end opposite a second open end, a plurality of terminal cavities greater than the predetermined number of electric connections so as to define an empty terminal cavity and a filled terminal cavity, wherein the empty terminal cavity is void of a terminal connection and a filled terminal cavity houses one of the predetermined number of electric connections, the plurality of terminal cavities extending between the first open end and the second open end;

a terminal positioning assurance member configured to engage the first open end;

a connector positioning assurance member configured to engage the second open end; and a predetermined number of blocking members, each of the predetermined number of blocking members disposed within each of the empty terminal cavities, each of the predetermined number of blocking members separating the terminal positioning assurance member from the connector positioning assurance member, the blocking member being a generally planar member disposed on a plane orthogonal to a longitudinal axis of the empty terminal, closing off each of said empty terminal cavities so as to prevent fluid transfer between the terminal positioning assurance member and the connector positioning assurance member.

14. The system as set forth in claim 13, wherein each of the predetermined number of blocking members is integrally formed within said one of the plurality of terminal cavities.

15. The system as set forth in claim 14, wherein each of the predetermined number of blocking members and the connector housing is monolithic.

16. The system as set forth in claim 13, further including a connector seal, the connector seal configured to engage the first open end of the connector housing, wherein the connector seal is pinched between the first open end of the connector housing and the terminal positioning assurance member.

17. The system as set forth in claim 13, wherein the connector housing includes a first clip, the first clip disposed on the second open end of the connector housing, the first clip configured to engage the connector positioning assurance member.

18. The system as set forth in claim 17, wherein the connector positioning assurance member includes a second clip configured to engage the first clip of the connector housing.

19. The system as set forth in claim 13, wherein the connector housing includes a terminal support member, the terminal support member having a plurality of top elongated channels, each of the plurality of top elongated channels configured to register with a corresponding plurality of terminal cavities.

20. The system as set forth in claim 19, wherein the terminal positioning assurance member includes a plurality of bottom elongated channels, each of the plurality of bottom elongated channels configured to register with a corresponding plurality of top elongated channel so as to form a plurality of terminal blade support channels for supporting a terminal blade.

* * * * *